US007186967B2

(12) United States Patent
Kato

(10) Patent No.: US 7,186,967 B2
(45) Date of Patent: Mar. 6, 2007

(54) OPTICAL TRANSDUCER HAVING OPTICAL FIBERS RESILIENTLY WARPED NEAR OPTICAL DEVICES AND MUSICAL INSTRUMENT USING THE SAME

(75) Inventor: Tadaharu Kato, Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 176 days.

(21) Appl. No.: 10/943,914

(22) Filed: Sep. 20, 2004

(65) Prior Publication Data

US 2005/0061959 A1 Mar. 24, 2005

(30) Foreign Application Priority Data

Sep. 18, 2003 (JP) ..... 2003-325731

(51) Int. Cl.
*H01J 40/14* (2006.01)

(52) U.S. Cl. ..... 250/221; 250/227.23

(58) Field of Classification Search ..... 250/221, 250/239, 227.23, 227.22, 227.21
See application file for complete search history.

(56) References Cited

U.S. PATENT DOCUMENTS 3,937,952 A * 2/1976 Ripley et al. ..... 250/227.22
4,480,183 A * 10/1984 Ely et al. ..... 250/227.22
5,909,028 A 6/1999 Yamamoto
2003/0202753 A1 10/2003 Kato et al.
2003/0202754 A1 10/2003 Kato et al.

FOREIGN PATENT DOCUMENTS

JP 9-152525 A 6/1997
JP 9-152871 A 6/1997

* cited by examiner

*Primary Examiner*—Que T. Le
(74) *Attorney, Agent, or Firm*—Smith Patent Office

(57) ABSTRACT

An optical transducer includes a light emitting unit, a light detecting unit, light radiating sensor heads and light receiving sensor heads; the light radiating sensor heads and light receiving sensor heads are alternately arranged at intervals, and moving objects pass through the intervals in such a manner as to intersect light beams between the sensor heads; since the light emitting unit and light detecting unit are remote from the sensor heads, the light emitting unit and light detecting units are optically coupled to the sensor heads through optical fibers; a bundle of optical fibers is clipped on a predetermined route, and the optical fibers swerve from predetermined points of the bundle so that the optical fibers are surely warped so as to exert the resilient force on the inner surfaces of the optical devices, thereby being kept stable during the adhesion therebetween.

20 Claims, 9 Drawing Sheets

OPTICAL TRANSDUCER HAVING OPTICAL FIBERS RESILIENTLY WARPED NEAR OPTICAL DEVICES AND MUSICAL INSTRUMENT USING THE SAME

FIELD OF THE INVENTION

This invention relates to an optical transducer and, more particularly, to an optical transducer having optical devices coupled through optical fibers and a musical instrument using the same.

DESCRIPTION OF THE RELATED ART

The optical transducer is a device that converts a non-electrical parameter, e.g. position, sound or pressure into electric signals through light. The optical transducers have found a wide variety of applications. One of the applicable technical fields is the musical instrument. The optical transducers are, by way of example, installed in the hybrid keyboard musical instrument. An automatic player piano and a mute piano are typical examples of the hybrid keyboard musical instrument, and the optical transducers convert the current position of moving objects such as keys and/or hammers to electric signals. The electric signals are supplied to a data processing system, and tones to be produced are determined through the analysis on the pieces of music data carried by the electric signals.

A typical example of the optical transducer is disclosed in Japanese Patent Application laid-open No. Hei 9-152525. The prior art optical transducer includes light emitting heads, light receiving heads, a multi-port light emitting device, a multi-port light detecting device, fiber retainers, a coupler and optical fibers. A bracket is provided under the keys, and slits are formed in the bracket at intervals for the keys. The light emitting heads and light receiving heads are hung from the reverse surface of the bracket, and the light emitting heads are alternated with the light receiving heads. Each of the slits is located at a middle of the area between the light emitting head and the associated light receiving head. The multi-port light emitting device and multi-port light detecting device are attached to the outer surface of the bracket by means of the coupler. A plug and a socket constitute the coupler.

The multi-port light emitting device is optically coupled to the light emitting heads through the optical fibers, and the light receiving heads are optically coupled to the associated ports of the multi-port light detecting device through the other optical fibers. Although the light emitting heads/light receiving heads are spaced from the end surfaces of the associated optical fibers, the fiber retainers, which are secured onto the reverse surface of the bracket, keep the relative position between the end surfaces and the light emitting heads/light receiving heads unchanged. The optical fibers are adhered to the associated fiber retainers, respectively.

Several optical fibers are assigned to each of the holes, which are formed in the plug, and are adhered to the plug as follows. First, the other end portions of the optical fibers are inserted into the associated holes, and are temporarily secured to the plug. Photo-cured liquid adhesive compound is injected into the holes, and is cured with the visible light. Then, the optical fibers are adhered to the inner surfaces of the plug. The plug is fixed to the bracket. On the other hand, the light emitting device and photo detecting diodes are secured to the socket. When the socket is assembled with the plug, the light emitting diodes and photo-detecting diodes are exactly opposed to the associated optical fibers.

The optical fibers are not previously routed between the fiber retainers and the plug, and are independently connected between the fiber retainers and the light emitting diodes/light detecting diodes.

Shutter plates are respectively attached to the lower surfaces of the keys, and are moved into and out of the bracket through the slits. Light beams are radiated from each light emitting head to the light receiving heads on both sides of the light emitting head, and are intersected with the shutter plates in the downward motion of the associated keys. The amount of light incident on the multi-port light receiving head is gradually reduced depending upon the current position of the key, and, accordingly, the amount of photo-current is reduced proportionally to the amount of the incident light. Thus, the prior art optical transducer converts the current key position to the photo-current, i.e., the electric signals.

A problem is encountered in the prior art optical transducer in that the optical fibers are liable to fall out. As described hereinbefore, the current key position is reported through the electric signals to the data processing system, and the data processing system produces the audio signal representative of the tones to be produced through the analysis on the pieces of data carried by the electric signals. If an optical fiber falls out from the plug, the prior art optical transducer can not inform the data processing system of the associated key motion so that the data processing system can not produce the audio signal for the tone to be produced.

The applicants have searched the database for related arts. Although several documents have drawn applicant's attention, these documents are silent to the above-mentioned problem and, accordingly, any countermeasure is not found therein.

One of the documents is U.S. Pat. No. 5,909,028 to Yamamoto. Yamamoto discloses a non-contact type position transducer of the type having optical fibers connected between the light-emitting blocks/light detecting blocks and the light emitting elements/light detecting elements. Yamamoto aimed at simplification of the non-contact type position transducer and enhancement in the utilization factor of the light, and did not pay any attention to how the optical fibers were to be routed. Although the optical fibers are gathered into plural bundles, the plural bundles of optical fibers remain separated. Each bundle of optical fibers is assigned to one of the light emitting elements or one of the light detecting elements, and the optical fibers, which are optically coupled to more than one light emitting element or more than one light detecting element, are not bundled together. Yamamoto is silent to how the bundles of optical fibers are to be routed between the light-emitting blocks/light detecting blocks and the light emitting elements/light detecting elements.

Another document is US 2003/0202753A1, which is a co-pending patent application. The optical transducer disclosed therein includes plural bundles of optical fibers connected between the light radiating sensor heads/light detecting sensor heads and the light emitting unit/light detecting unit. However, the bundles of optical fibers remain separated, and Kato, who is one of the inventors of the disclosed invention, is silent to how the bundles of optical fibers are to be routed between the light radiating sensor heads/light detecting sensor heads and the light emitting unit/light detecting unit. Moreover, Kato et al. does not teach any bundle of optical fibers clipped on a predetermined route. The relation between the optical fibers and the light emitting diodes/light detecting elements is same as that disclosed in U.S. Pat. No. 5,909,028.

Yet another document is US 2003/0202754A1, which is also a co-pending patent application. The optical transducer disclosed therein is similar in system configuration to the optical transducer disclosed in US 2003/0202753A1, and the plural bundles of optical fibers are connected between the light radiating sensor heads/light detecting sensor heads and the light emitting unit/light detecting unit. However, the bundles of optical fibers also remain separated, and Kato et al. is silent to how the bundles of optical fibers are to be routed between the light radiating sensor heads/light detecting sensor heads and the light emitting unit/light detecting unit. Moreover, Kato et al. does not teach any bundle of optical fibers clipped on a predetermined route. The relation between the optical fibers and the light emitting diodes/light detecting elements is similar to that disclosed in U.S. Pat. No. 5,909,028.

SUMMARY OF THE INVENTION

It is therefore an important object of the present invention to provide an optical transducer, optical fibers of which are less liable to fall out.

It is also an important object of the present invention to provide a musical instrument, which is equipped with the optical transducer.

The prevent inventor contemplated the problem inherent in the prior art optical transducer, and noticed an optical fiber or some optical fibers of the bundle straightly penetrate into the hole of the plug. The optical fiber or fibers, which straightly penetrated into the hole, were much liable to fall out. On the other hand, the other optical fibers were warped near the plug, and were strongly adhered to the inner surface of the plug. The present inventor considered these two groups of the optical fibers, and concluded that the resilient force kept the warped optical fibers stable on the inner surface by virtue of the increased friction while the worker was fixing the optical fiber to the inner surface.

The same phenomenon was observed in several light radiating sensor heads/light detecting sensor heads. An optical fiber was straightly inserted into the light radiating sensor head/light detecting sensor head, and another optical fiber was slightly warped near the light radiating sensor head/light detecting sensor head. The present inventor found that the straightly inserted optical fiber and slightly warped optical fibers were also liable to fall out.

The present inventor investigated the cause of the straight or gently warped optical fibers, and noticed that the bundle of optical fibers was freely movable. Even if the optical fibers had been initially warped, the resiliency of the optical fibers caused the bundle to change the location and/or the diverging point of the optical fibers. This resulted in the straight and gently warped optical fibers.

To accomplish the object, the present invention proposes to clip optical fibers onto a predetermined route.

In accordance with one aspect of the present invention, there is provided an optical transducer for converting status of objects to electric signals comprising a light emitting unit for emitting light, a light detecting unit for converting incident light to the electric signals, plural optical sensor heads selectively coupled to the light emitting unit and the light detecting unit and bridging gaps respectively assigned to the objects with the light so as to supply the incident light representative of the status to the light detecting unit, a frame having a route immovable with respect to the light emitting unit, the light detecting unit and the plural optical sensor heads, plural optical fibers connected between the light emitting unit, the light detecting unit and the plural optical sensor heads and having respective warped end portions connected to at least either the light emitting unit and light detecting unit or the plural optical sensor heads, and a fastener keeping the plural optical fibers stable on the route.

In accordance with another aspect of the present invention, there is provided a musical instrument for producing tones comprising plural manipulators independently moved for specifying an attribute of tones, an optical transducer monitoring the plural manipulators to see whether or not the manipulators changes status so as to produce pieces of status data representative of the status and including a light emitting unit for emitting light, a light detecting unit determining the status on the basis of incident light, plural optical sensor heads selectively coupled to the light emitting unit and the light detecting unit and bridging gaps respectively assigned to the manipulators with the light for supplying the incident light to the light detecting unit, a frame having a route immovable with respect to the light emitting unit, the light detecting unit and the plural optical sensor heads, plural optical fibers connected between the light emitting unit, the light detecting unit and the plural optical sensor heads and having respective warped end portions connected to at least either the light emitting unit and light detecting unit or the plural optical sensor heads and a fastener keeping the plural optical fibers stable on the route, and a tone generating system connected to the optical transducer, and producing the tones on the basis of the pieces of status data.

BRIEF DESCRIPTION OF THE DRAWINGS

The features and advantages of the optical transducer and the musical instrument will be more clearly understood from the following description taken in conjunction with the accompanying drawings, in which.

DESCRIPTION OF THE PREFERRED EMBODIMENTS

In the following description, words "front" and "rear" are indicative of positions on a keyboard musical instrument, in which an optical transducer has been installed. The word "front" is indicative of a position closer to a player, who is sitting on a stool for fingering a piece of music, than a position modified with the word "rear". The direction of a line drawn between a front position and a corresponding rear position is referred to as "fore-and-aft" direction, and "lateral" direction crosses the fore-and-aft direction at right angle. Although the words "front position" and "rear position" on the optical transducer are not correlated with those on the keyboard musical instrument before the installation, positions on the optical transducers are hereinafter modified with the words "front" and "rear" as if the optical transducer has been already installed in the keyboard musical instrument.

Optical Transducer

Figure 1:
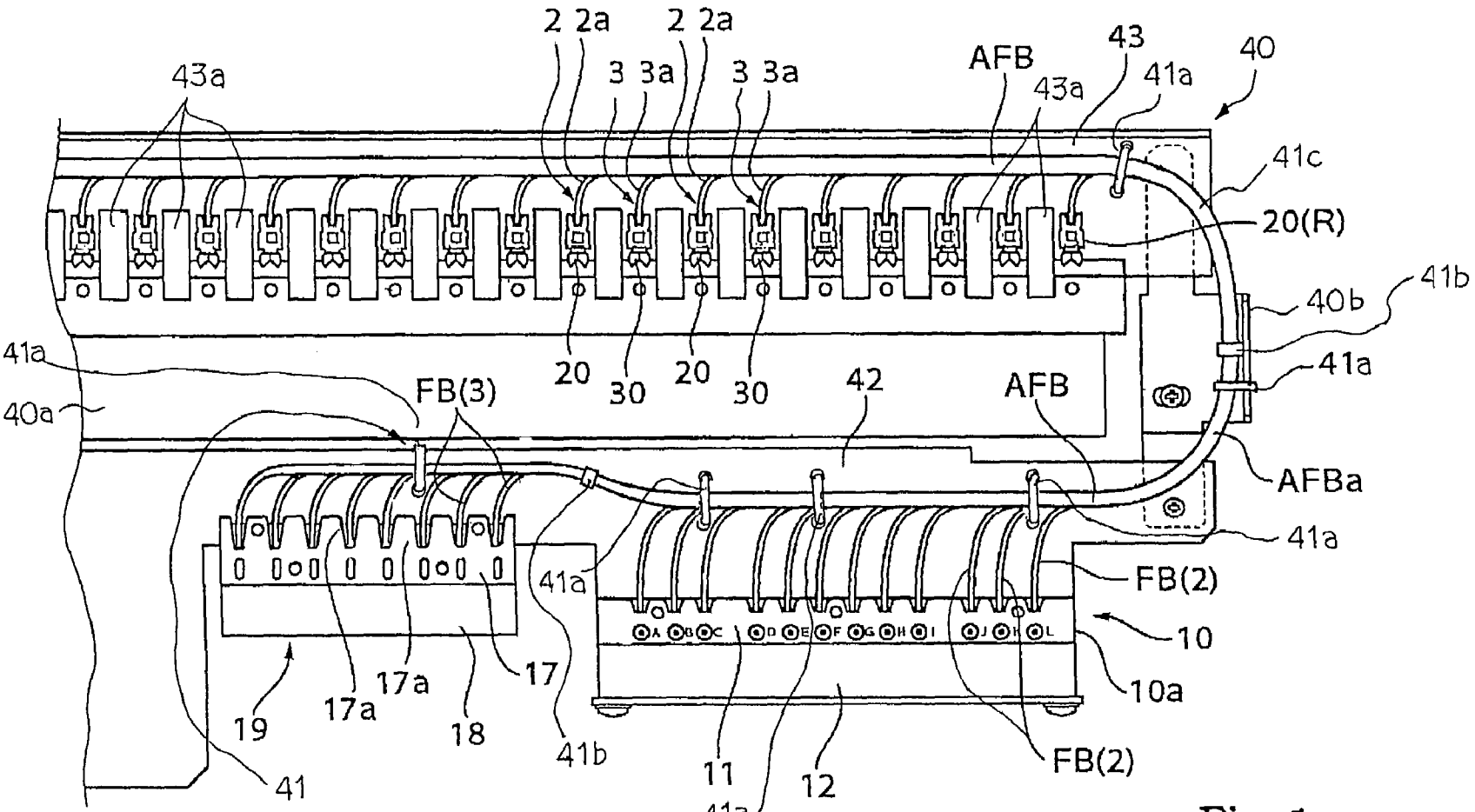
FIG. 1 is a plan view showing the arrangement of component parts of an optical transducer according to the present invention.

Referring to FIG. 1 of the drawings, an optical transducer embodying the present invention largely comprises optical fibers 2/3, a light emitting unit 10, a light detecting unit 19, light radiating sensor heads 20, light receiving sensor heads 30, a base frame 40 and a fastener 41. The basic frame 40 is turned over, and the light radiating sensor heads 20, light receiving sensor heads 30 and optical fibers 2/3 are arranged on the reverse surface of the base frame 40. In this instance, the light emitting unit 10 and light detecting unit 19 are located in front of the light radiating sensor heads/light receiving sensor heads 20/30.

The light radiating sensor heads 20 and light receiving sensor heads 30 are secured to the base frame 40, and are remote form the light emitting unit 10 and light detecting unit 19. The light emitting unit 10 and light detecting unit 19 are fixed to the base frame 40, and are connected to the light radiating sensor heads 20 and light receiving sensor heads 30 through the optical fibers 2 and optical fibers 3, respectively. The optical fibers 2/3 extend on a predetermined route on the reverse surface, and are fastened to the base frame 40 by means of the fastener 41. In other words, the optical fibers 2/3 are clipped on the predetermined route by virtue of the fastener 41, and do not get out of the route. The route is determined in such a manner that each of the optical fibers 2/3 has a warped end portion so as to exert resilient force on certain surface of the associated optical device, i.e., the light emitting unit 10, light detecting unit 19, light radiating sensor head 20 and light receiving sensor head 30. The resilient force is large enough to keep the end portions stable on the certain surfaces while a worker is fixing the end portions to the optical device.

Assuming now that two points are spaced from each other on a plane, an arc of a predetermined length is drawn along only one route between the two points. The route is unchanged in so far as one of the two points is not moved on the plane. In other words, if the length of arc and the coordinates of the two points are given on the plane, the route is unique to the arc on the plane. When certain force is exerted on both ends of the optical fiber 2/3, the optical fiber 2/3 is warped along the route. The optical fibers 2/3 are made of certain material, the properties of which have been already known, and the dimensions of the cross section are known. The certain force, which is exerted on both ends of the arc, is determinable on the basis of those data. If the certain force gives rise to friction large enough to keep the optical fiber 2/3 stable on the surface, the optical fibers 2/3 do not fall out in the work to fix the end portions to the optical devices. As a result of the above-described analysis, it is possible to keep the optical fibers 2/3 stable on the surface of the optical devices in so far as the point at which the optical fibers 2/3 swerve from the route, location of the optical device and the length of optical fibers 2/3 between the point and the end surface are exactly determined.

Turning to the embodiment, the optical devices 10/19/20/30 are immovable on the reverse surface of the base frame 40, and the optical fibers 2/3 are clipped on the predetermined route. In this situation, it is easy to determine the length of the warped portion and the point at which the optical fibers 2/3 swerve from the predetermined route.

Description is made on the arrangement of the component parts 2/3, 10/19, 20/30, 40 and 41 in more detail. The light radiating sensor heads 20 and light receiving sensor heads 30 are alternately arranged in the lateral direction at intervals, and are remote from the light emitting unit 10 and light detecting unit 19. The light emitting unit 10 is slightly offset from the light detecting unit 19 in the fore-and-aft direction, and is laterally spaced from the light detecting unit 19.

In this instance, the base frame 40 is laterally elongated, and is separated into three sections, which are a central section 40*a*, a front section 42 and a rear section 43. The front section 42 and rear section 43 are respectively assigned to the light radiating sensor heads/light receiving sensor heads 20/30 and the light emitting unit/light detecting unit 10/19. Although a data processing module is further assigned to the front section 42, the data processor module is located on the left side of the light detecting unit 19, and is not shown in FIG. 1. The light radiating sensor heads 20 and light receiving sensor heads 30 are disposed onto the reverse surface of the rear section 43 at intervals, and slots 43*a* are formed in the rear section 43 at intervals. Each of the slots 43*a* is located in an area between the light radiating sensor head 20 and the adjacent light receiving sensor head 30. The light emitting unit 10 and light detecting unit 19 are provided in the space between the rightmost light radiating sensor head 20(R) and the leftmost light radiating sensor head (not shown).

The central section 40*a* is contiguous to the rear section 43, and is retracted from the right sides of the front/rear sections 42/43. The gap between the front section 42 and the rear section 43 is bridged with a connecting plate 40*b* on the right side of the central section 40*a*, and the connecting plate 40*b* is fixed at the front end portion to the front section 42 and at the rear end portion to the rear section 43. Thus, the front section 42 is connected to the rear section 43 by means of the connecting plate 40*b* on the right side of the rightmost light radiating sensor head 20(R).

The optical fibers 2/3 laterally extend on the rear section 43 at the back of the light radiating sensor heads/light receiving sensor heads 20/30, and turn around in the right portion of the rear section 43. The optical fibers 2/3 pass over the connecting plate 40*b*. The optical fibers 2/3 turn around in the right portion of the front section 42, and laterally extend on the front section 42 at the back of the light emitting device/light detecting device 10/19. Thus, the optical fibers 2/3 are twice sharply warped at the back of and in front of the connecting plate 40*b*. The optical fibers 2/3 are fastened to the rear section/connecting plate/front section 43/40*b*/42 by means of synthetic resin strips 41*a*, which form in combination the fastener 41, and the synthetic resin strips 41*a* make the optical fibers 2/3 immovable on the route.

One of the synthetic resin strips 41*a* passes through a pair of holes, which is formed in the right portion of the rear section 43, and the optical fibers 2/3 are fastened to the right portion by means of the synthetic resin strips 41*a*. Another synthetic resin strip 41*a* passes through a hole formed in the connecting plate 40*b*, and the optical fibers 2/3 are bonded to the connecting plate 40*b*. Plural pairs of holes are further formed in the front section 42, and are arranged laterally at intervals. The other synthetic resin strips 41*a* are assigned to the plural pairs of holes, and pass through the associated pairs of holes so that the optical fibers 2/3 are bonded to the front section 42. Thus, the optical fibers 2/3 are bonded to the base frame 40 along the predetermined route by means of the synthetic resin strips 41*a*.

Although the sharply warped optical fibers 2/3 tend to make themselves straight due to the resiliency thereof, the synthetic resin strips 41*a* keep the optical fibers 2/3 sharply warped against the resilient force.

The optical fibers 2/3 are made of transparent synthetic resin such as, for example, acrylic resin. The optical fibers 2/3 have a circular cross section, the diameter of which is of the order of 0.5 millimeter. In the following description, term "minor bundle" means a bundle of several optical fibers 2 or 3, and term "major" bundle is indicative of a bundle of the minor bundles. The major bundle of optical fibers 2/3 is labeled with "AFB". The major bundle AFB has a warped portion AFBa between the rightmost synthetic resin strip 41*a* on the rear section 43 and the rightmost synthetic resin strip 41*a* on the front section 42. The warped portion AFBa sideward projects on the right side of the light side surface 10*a* of the light emitting unit 10. The minor bundles of optical fibers 2 are labeled with "FB(2)", and the minor bundles of optical fibers 3 are labeled with "FB(3)". The minor bundles FB(2)/FB(3) have a diameter ranging from 1.1 millimeters to 1.55 millimeters. In this instance, all the minor bundles FB(a)/FB(3) are wrapped with a shield 41*c*, and are locked with rings 41*b*. The optical fibers 2/3 are drawn from the major bundle AFB for the light radiating sensor heads/light receiving sensor heads 20/30, and the minor bundles FB(2)/FB(3) are separated from the major bundle AFB near the light emitting unit/light detecting unit 10/19.

The light emitting unit 10 has twelve light output ports A/B/C/D/E/F/G/H/I/J/K/L, and sequentially emits the light from the twelve light output ports A–L. On the other hand, the light detecting unit 19 has eight light input ports 17*a*, and concurrently converts the light incident at the eight light input ports 17*a* to electric signals. The optical fibers 2 are separated into the twelve minor bundles FB(2), and the twelve minor bundles FB(2) of optical fibers 2 are branched from the major bundle AFB of optical fibers 2/3 at intervals. There are the diverging points on the right side of the associated light output ports A to L. The twelve minor bundles FB(2) are respectively assigned to the twelve light output ports A to L. The bundles FB(2) measure 10–12 millimeters long from the diverging point to the light input end surfaces. The light input end portions of the bundles FB(2) are respectively inserted into the light output ports A to L, and are secured to the inner surfaces, which define the light output ports A to L, respectively. In this instance, the light output ports A to L are 7 millimeters deep, and the light input end portions are adhered to the inner surfaces by means of adhesive compound. The remaining end portions of the bundles FB(2), which are 3 millimeters to 5 millimeters long, are exposed to the outside of the light output ports A to L, and are longer than the distance between the diverging points and the associated light output ports A to L.

While a worker is assembling the bundles FB(2) with the light emitting unit 10, the worker warps the bundles FB(2) for directing the light input end portions to the light output ports A–L, and inserts the light input end portions into the light output ports A–L. Since the major bundle AFB is clipped on the route, i.e., immovable on the route, the light input end portions are pressed to the inner surfaces and one another. Subsequently, the worker injects liquid adhesive compound into the light output ports A to L. The resiliency of the bundles FB(2) keeps the light input end portions stable on the inner surfaces during the solidification of the liquid adhesive compound. Thus, the optical fibers 2 of each bundle FB(2) are securely adhered to one another and to the inner surface of the light emitting unit 10. Any optical fiber 2 does not fall out from the light emitting port A, B . . . or L.

The eight light input ports 17*a* are assigned to the eight minor bundles FB(3) of the optical fibers 3, respectively. The major bundle AFB is branched into the eight minor bundles FB(3) of the optical fiber 3 at intervals, and the diverging points are on the right side of the associated light input ports 17*a*. The light input ports 17*a* are also 7 millimeters deep, and the light output end portions of the bundles FB(3) also measure 10 to 12 millimeters long. The remaining portions, which are exposed to the outside of the light input ports 17*a*, are longer than the distance between the diverging points and the associated light input ports 17*a*. The bundles FB(3) are warped for directing the light output end portions to the light input ports 17*a*, and the light output end portions are respectively inserted into the light input ports 17*a* of the light detecting unit 19. The light output end portions are adhered to the inner surfaces of the light detecting unit 19 by means of the adhesive compound. The light output end portions are resiliently pressed onto the inner surfaces of the light detecting unit 19 during the solidification of the adhesive compound as similar to the light input end portions, and are securely adhered to one another and to the inner surfaces of the light detecting unit 19. Thus, the optical fibers 3 do not fall from the light input ports 17*a*.

The major bundle AFB laterally extends on the rear section 43 at the back of the array of the light radiating sensor heads/light receiving sensor heads 20/30, and the optical fibers 2 and optical fiber 3 are alternately branched from the major bundle AFB at intervals. The diverging points are on the right side of the associated light radiating sensor heads/light receiving sensor heads 20/30, and the optical fibers 2/3 have respective end portions 2*a*/3*a* between the diverging points and the light input/output end surfaces. In this instance, the end portions 2*a*/2*a* are of the order of 20 millimeters long. The light radiating sensor heads 2 and light receiving sensor heads 3 are formed with rear holes, and the rear holes are 7 millimeters deep. The optical fibers 2/3 are individually inserted into the rear holes, and are secured to the associated light radiating sensor heads/light receiving sensor heads 20/30 by means of the adhesive compound.

Figure 2:
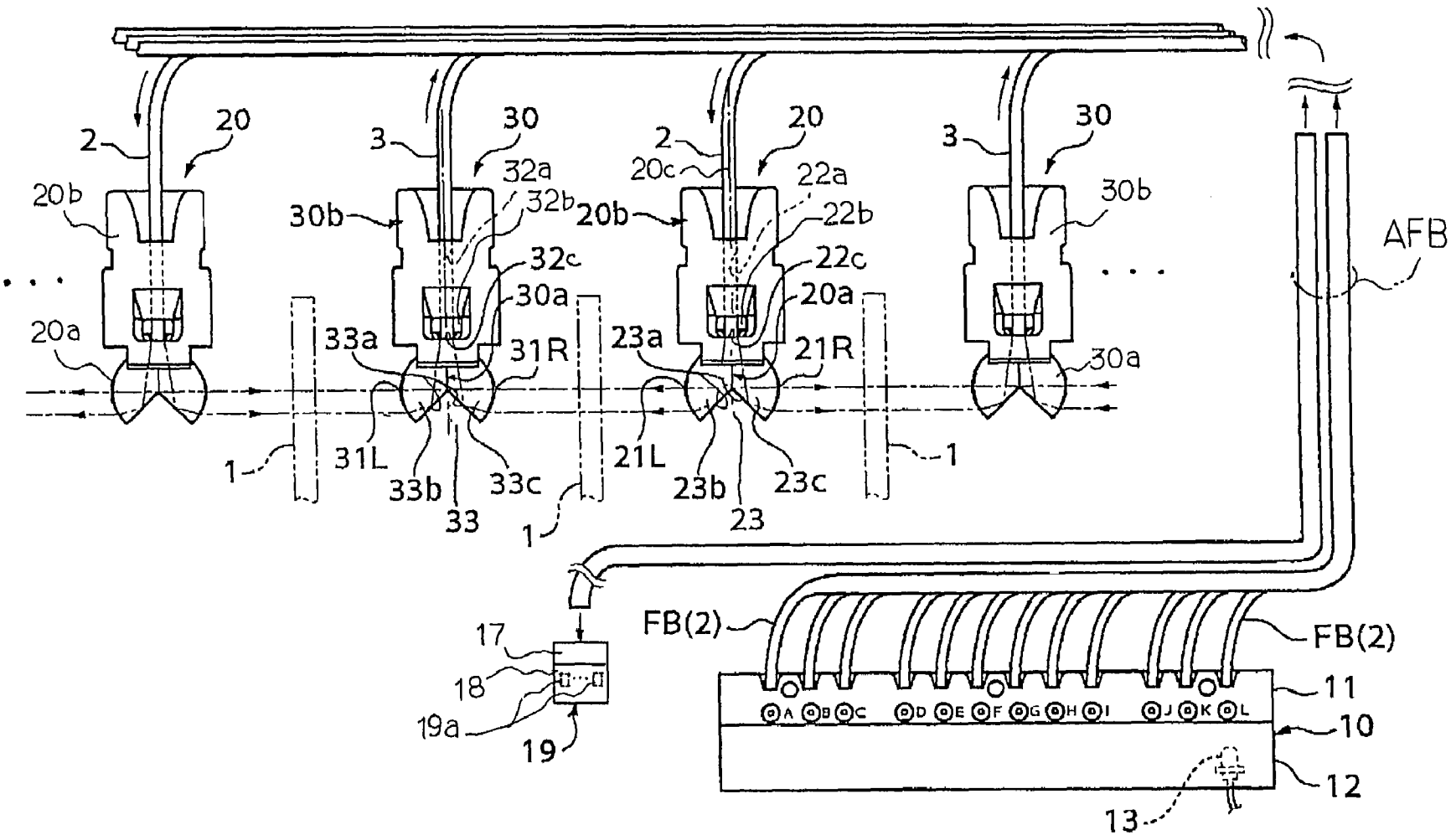
FIG. 2 is a plan view showing four optical sensor heads, which form parts of the optical transducer.

Turning to FIG. 2, the light radiating sensor heads 20 and light receiving sensor heads 30 are illustrated at a large magnification ratio. The light radiating sensor heads and light receiving sensor heads 20/30 are made of transparent material such as, for example, acrylic resin, and are identical in contour with one another. The transparent material may be shaped into the light radiating sensor heads/light receiving sensor heads 20/30 through a molding process.

Each of the light radiating sensor heads 20 is imaginarily broken down into a head 20*a* and a body 20*b*, and has a line of symmetry 20*c*. The optical fiber 2 is secured to the body

20*b*, and radiates the light to the head 20*a*. The head 20*a* splits the light into two light beams, and sideward outputs the light beams toward the light receiving sensor heads 30 on both sides thereof.

The body 20*b* is formed with a hole 22*a*, and the hole 22*a* is open to a pit 22*b*. The hole 22*a* has a centerline, which is coincident with the line of symmetry 20*c*. The optical fiber 2 passes through the hole 22*a* and pit 22*b*, and is tightly held in contact with an end surface 22*c*, which defines a part of the pit 22*b*. For this reason, the light is radiated from the optical fiber 2 toward the head 20*a* along the line of symmetry 20*c*. The optical fiber 2 is fixed to the body 20*b* so as to keep the face-to-face contact with the end surface 20*c*. Though not shown in FIG. 2, an injection hole is further formed in the body 20*b*, and is open to the hole 22*a*.

The head 20*a* includes a pair of convex lenses 21L/21R and a pair of prisms 23*b*/23*c*. The prisms 23*b*/23*c* have respective reflecting surfaces 23*a*, and the reflecting surfaces 23*a* crosses each other at 90 degrees on the line of symmetry 20*c*. In other words, the reflecting surfaces 23*a* are inclined to the line of symmetry 20*c* at 45 degrees. The reflecting surfaces 23*a* form a V-shaped space 23. The convex lenses 21L/21R sideward project from the prisms 23*b*/23*c*, and are opposed to the adjacent light receiving optical sensor heads 30. The optical axes of the convex lenses 21L/21R cross the crossing line between the reflecting surfaces 23*a*.

The eight is propagated from one of the light output port A, B, . . . or L through the optical fibers 2 to the light radiating sensor head 20, and is incident onto the end surface 22*c*. The output light proceeds to the reflecting surface 23*a* along the line of symmetry 20*c*. The output light is reflected on the reflecting surfaces 20*a*, and is split into two light beams. The light beams sideward proceeds, and are formed into parallel light beams by means of the convex lenses 21L/21R. Thus, the parallel light beams are output from the light radiating sensor head 20 toward the adjacent light receiving sensor heads 30.

The light receiving sensor head 30 is also broken down into a head 30*a* and a body 30*b*, and has a line of symmetry 30*c*. The head 30*a* and body 30*b* are identical with the head 20*a* and body 20*b*. For this reason, a hole, a pit, an end surface, reflecting surfaces, prisms, convex lenses and a V-shaped space, which are respectively corresponding to the hole 22*a*, pit 22*b*, end surface 22*c*, reflecting surfaces 23*a*, prisms 23*b*/23*c*, convex lenses 21L/21R and a V-shaped space 23, are labeled with references 32*a*, 32*b*, 32*c*, 33*a*, 33*b*/33*c*, 31L/31R and 33 without detailed description for the sake of simplicity.

The optical fibers 2/3 are fixed to the light radiating sensor heads/light receiving sensor heads 20/30 as follows. The location of the light radiating sensor heads/light receiving sensor heads 20/30 is known, and the route for the major bundle AFB has been already determined. The force to be exerted on the inner surfaces of the bodies 20*b*/30*b* is experimentally determined. Then, the routes between the swerving points and the light radiating sensor heads/light receiving sensor heads 20/30 are calculated, and the points at which the optical fibers 2/3 swerve and the length of the light output end portions/light input end portions are determined. The worker branches the major bundle AFB into the optical fibers 2/3 at the predetermined points, and inserts the light output end portions and light output end portions into the holes 22*a*/32*a*. The light output end portions and light input end portions are pressed to the inner surfaces of the bodies 20*b*/30*b*, and are stable thereon by virtue of the resiliency of the optical fibers 2/3. The worker injects the light-cured liquid adhesive compound into the injection holes (not shown), and exposes the liquid adhesive compound to the light. The adhesive compound is solidified, and makes the optical fibers 2/3 securely fixed to the inner surfaces of the bodies 20*b*/30*b*. While the liquid adhesive compound is being solidified in the light, the light output end portions/light input end portions are pressed to the inner surfaces, and are stable thereon. This results in that the optical fibers 2/3 do not fall out from the light radiating sensor heads/light receiving sensor heads 20/30.

The parallel light beams are incident on the convex lenses 31R/31L of the adjacent light receiving sensor heads 30, and are reflected on the reflecting surfaces 33*a*. The light beams are incident on the light input end surfaces of the optical fibers 3. The input light is propagated through the optical fibers, and reaches the different light input ports 17*a* of the light detecting unit 19.

Reference numeral 1 designates moving objects. The moving objects are moved along trajectories, and penetrate through the slots 43*a* into the space where the light radiating sensor heads/light receiving sensor heads 20/30 are installed. Each of the moving objects gradually crosses associated one of the parallel light beams, and partially intersects the parallel light beam. For this reason, the amount of light incident on the convex lens 31L or 31R is varied together with the current position of the moving object.

The light emitting unit 10 includes an optical fiber plug 11, a light emitting diode socket 12 and light emitting elements 13. The light output ports A to L are formed in the optical fiber plug 11, and the light emitting elements 13, which may be implemented by light emitting diodes, are held inside the light emitting diode socket 12. The optical fiber plug 11 is assembled with the light emitting diode socket 12 so that the light emitting elements 13 are respectively opposed to the light output ports A to L. The optical fibers 2 are bundled to the twelve minor bundles FB(2), and the twelve minor bundles FB(2) are terminated at the light output ports A to L. Though not shown in the drawings, a driver circuit sequentially energizes the light emitting elements 13 with an electric driving pulse signal, and light pulses are emitted from the light emitting elements 13 to the light output ports A to L. The driving circuit repeatedly scans the light emitting elements 13 with the driving pulse signal so that the light pulses are distributed to the light radiating sensor heads 20 through the minor bundles FB(2) of the optical fibers 2.

The light emitting unit 10 is hereinafter described in more detail with reference to FIGS. 3, 4 and 5. As described hereinbefore, the light-emitting unit 10 includes the optical fiber plug 11, light emitting diode socket 12 and twelve light emitting diodes 13. The light emitting unit 10 further includes twelve collimator lens units 15, which are not seen in FIGS. 1 and 2.

In the following description with reference to FIGS. 3, 4 and 5, term "front" is indicative of a position closer to the bundles FB(2) of the optical fibers 2 than a "rear" position. For example, the optical fiber plug 11 is in front of the light-emitting diode socket 12, and the "front" is closer to the right side of the sheets of paper than the "rear" in FIGS. 4 and 5.

The optical fiber plug 11 has a generally rectangular parallelepiped shape, and a pair of spigots lid sideward projects from the rear end portion. Namely, the optical fiber plug 11 has a cross section like an inverted T-letter. In this instance, the optical fiber plug 11 is made of transparent synthetic resin such as, for example, polycarbonate. Twelve cylindrical through-holes 11*a* are formed in the optical fiber plug 11 at intervals, and have a circular cross section corresponding to the cross section of the associated minor bundles FB(2). The cylindrical through-holes 11*a* are open at the front ends to valleys 11*e*, and reach the rear end surface 11*c*. The center axis of the cylindrical through-hole 11*a* is labeled with CL1 in FIG. 4. The cylindrical through-holes 11*a* are respectively assigned to the bundles FB(2) of the optical fibers 2, and the center axis of the bundle FB(2) is labeled with CL2. When the bundles FB(2) are inserted into the cylindrical through-holes 11*a*, the center axes CL1 are coincident with the center axes CL2 as shown in FIG. 5.

Twelve injection holes 11*b* are further formed in the optical fiber plug 11. The injection holes 11*b* are respectively assigned to the cylindrical through-holes 11*a*, and extend from the side surface of the optical fiber plug 11 to the associated through-holes 11*a* as will be better seen in FIG. 4.

The spigots 11*d* extend in parallel along the side surfaces of the optical fiber plug 11. However, the spigots 11*d* are separated into left portions and right portions. Gaps 11*e*2 are formed between the left portions and the right portions. The gaps 11*e*2 serve as a locator in the assemblage between the optical fiber plug 11 and the light emitting diode socket 12 as will be described hereinlater in detail.

The light-emitting diode socket 12 has a generally rectangular parallele-piped shape, and is as long as the optical fiber plug 11. In this instance, the light-emitting diode socket 12 is made of copolymer of acrylonitril-butadiene-styrene, i.e., ABS resin. Twelve through-holes 12*a* are formed in the light-emitting diode socket 12 at intervals, which are equal to the intervals of the cylindrical through-holes 11*a*. The through-holes 12*a* are open at the front ends thereof to a socket 12*c*, and reach the rear end surface. The center line of the through-hole 12*a* is labeled with CL3. The through-holes 12*a* are broken down into rear zones 12*aa* and front zones 12*ab*. The rear zones 12*aa* are larger in diameter than the front zones 12*ab*, and, for this reason, shoulders 12*e* take place between the rear zones 12*aa* and the front zones 12*ab*. The diameter of the front zones 12*ab* is less than the width of the socket 12*c* so that the front zones 12*ab* are open to the socket 12*c* through the bottom wall. The rear zones 12*aa* are diverged in the rear end portion, and are open to the outside.

The socket 12*c* extends in the longitudinal direction of the light-emitting diode socket 12 like a groove, and has the constant width approximately equal to the distance between the end surfaces of the spigots 11*d*. For this reason, the pair of spigots 11*d* is snugly received in the socket 12*c*, and the rear surface 11*c* is brought into contact with the bottom surface. The depth of socket 12*c* is less than the distance between the rear surface 11*c* and the injection hole 11*b*. When the optical fiber plug 11 is assembled with the light emitting diode socket 12, the rear end surface 11*c* is brought into contact with the bottom surface 12*b*, and keeps the injection hole 11*b* outside of the socket 12*c* as shown in FIG. 5. Thus, the pair of spigots 11*d* is snugly received in the socket 12*c*, and the virtual plane where the centerline CL3 extend is made coplanar with the virtual plane where the centerline CL1 extend.

In the assembling work, the minor bundles FB(2) are inserted into the cylindrical through-holes 11*a*, respectively. The minor bundles FB(2) may come out from the rear surface 11*c*. The resiliency of the minor bundles FB(2) urges the light input ends portions to be pressed to the inner surface of the optical fiber plug 11, and keeps the optical fibers 2 stable in the cylindrical through-holes 11*a*. The light-cured liquid adhesive compound is injected into the injection holes 11*b*. The light-cured liquid adhesive compound penetrates into the boundary between the inner surface and the minor bundles FB(2) and further into the bundles FB(2) of the optical fibers 2. The light-cured liquid adhesive compound thus injected is exposed to the light so that the optical fibers 2 are adhered to one another and to the inner surface of the optical fiber plug 11. While the light is curing the liquid adhesive compound, the optical fibers 2 are immovable by virtue of the friction, and are securely adhered to one another and the inner surface. If the minor bundles FB(2) project from the rear surfaces 11*c*, the minor bundles FB(2) are cut off, and the light input end surfaces are made coplanar with the rear surfaces 11*c*.

The light-emitting diode socket 12 is formed with a pair of lugs 12*d*1/12*d*2. The lugs 12*d*1/12*d*2 project into the socket 12*c* (see FIG. 3), and are confronted with one another. The lugs 12*d*1/12*d*2 are spaced from right surface of the light-emitting diode socket 12 by a predetermined distance, and the gaps 11*e*2 are also spaced from the right surface by the predetermined distance. The width of the lugs 12*d*1/12*d*2 is approximately equal to the width of the gaps 11*e*2 so that the lugs 12*d*1/12*d*2 are snugly received in the gaps 11*e*2. When the lugs 12*d*1/12*d*2 are received in the gaps 11*e*2, the right surface and left surface of the optical fiber plug 11 become coplanar with the right surface and left surface of the light-emitting diode socket 12, respectively, and the centerlines CL1 are automatically aligned with the centerlines CL3, respectively. Thus, the spigots 11*d*/socket 12*c* and gaps 11*e*2/lugs 12*d*1/12*d*2 make the centerlines CL1 automatically aligned with the centerlines CL3.

The collimator lens units 15 have a generally cylindrical shape, and have respective cylindrical bodies 15*f* and respective deformable tails 15*h*. The collimator lens units 15 are made of transparent synthetic resin such as, for example, acrylic resin. Cylindrical recesses 15*a* are formed in the collimator lens units 15, and have center axes CL4. The cylindrical recesses 15*a* penetrate from the rear end surfaces 15*g* through the tails 15*h* into the cylindrical bodies 15*f*, and slits 15*d* are formed in the tails 15*h*. In other words, each tail 15*h* is separated into four pieces. When the four pieces are pressed outwardly, the pieces are deformed in such a manner to increase the diameter of the cylindrical recess 15*a*.

The cylindrical bodies 15*f* are approximately equal in diameter to the rear zones 12*aa* of the through-holes 12*a*, and are larger in diameter than the front zones 12*ab*. For this reason, when the collimator lens units 15 are inserted into the through-holes 12*a*, the front surfaces 15*c* are brought into contact with the shoulders 12*e*, and the center axes CL4 become coincident with the center axes CL3, respectively.

Collimator lenses 15*b* define the bottoms of the cylindrical recesses 15*a*, and are slightly retracted from the front end surfaces 15*c*. In other words, guard portions 15*e* are formed in the cylindrical bodies 15*f*, and prevent the collimator lenses 15*b* from undesirable contaminant and mechanical damages. The collimator lenses 15*b* have respective optical axes coincident with the center axes CL4, respectively. The collimator lenses 15*b* are smaller in diameter than the front zones 12*ab*, and are larger in diameter than the minor bundle FB(2). The collimator lenses 15*b* condense the light onto the minor bundles FB(2) of the optical fibers 2, and a large amount of light is incident on the end surfaces of the minor bundles FB(2) of the optical fibers 2.

The light emitting diodes 13 are similar in structure to one another. Each of the light emitting diodes 13 includes a disc-shaped substrate 16, a semiconductor light emitting diode (not shown) on the disc-shaped substrate 16, a semi-ellipsoid cover piece 14 and electrodes 13*a*. The semiconductor light emitting diode (not shown) is mounted on the front surface 16*a* of the disc-shaped substrate 16, and is covered with the semi-ellipsoid cover piece 14. Electric power is supplied through the electrodes 13*a* to the semiconductor light emitting diodes, and causes the semiconductor light emitting diodes to radiate laser light. The semi-ellipsoid cover piece 14 has a center axis CL5, and the center axis CL5 serves as the optical axis for the light radiated from the semiconductor light emitting diode. The semi-ellipsoid cover piece 14 is transparent to the light radiated from the semiconductor light emitting diode. The disc-shaped substrate 16 is larger in diameter than the cylindrical recess 15*a*, and the semi-ellipsoid cover piece 14 is gradually increased in diameter toward the disc-shaped substrate 16. The diameter of the semi-ellipsoid cover piece 14 is maximized on the front surface 16*a*, and the maximum diameter is slightly greater than the diameter of the cylindrical recess 15*a*. When the light-emitting diode 13 is pushed into the cylindrical recess 15*a*, the semi-ellipsoid cover piece 14 is brought into contact with the collimator lens 15*b*, and the rear surface 15*g* is brought into contact with the peripheral area of the front surface 16*a*. The peripheral surface 14*a* pushes the separated tail 15*h* outwardly, and the separated pieces are deformed. For this reason, the resilient force is exerted on the peripheral surface 14*a*, and the semi-ellipsoid cover piece is clamped by the separated tail 15*h*. The center axis CL5 is coincident with the center axis CL4.

The light detecting unit 19 also includes an optical fiber plug 17, a socket 18 and eight light detecting elements 19*a* such as, for example, photo-detecting transistors. The optical fiber plug 17 is formed with the eight light input ports 17*a*, and the light detecting elements 19*a* are held inside the socket 18. The plug 17 is assembled with the socket 18 so that the light input ports 17*a* are opposed to the light detecting elements 19*a*. The light detecting elements 19*a* convert the incident light to photo current, and the amount of photo current is proportional to the amount of incident light. The light detecting unit 19 is similar in structure to the light emitting unit 10, and no further description is hereinafter incorporated for the sake of simplicity.

A method of scanning is disclosed in Japanese Patent Application laid-open No. Hei 9-152871. A matrix of switches may be connected between the light emitting unit 10 and the light detecting unit 19. In this instance, the switches selectively turn on and off so as sequentially to check light detecting elements 19*a* for the moving objects 1. A time frame, which consists of twelve time slots, may be repeated for the scanning. The twelve light emitting elements 13 are respectively assigned to the twelve time slots, and the light emitting elements 13 are selectively energized with the driving pulse signal in the twelve time slots. The eight light radiating sensor heads 20, which are optically coupled through the minor bundle FB(2) to one of the light emitting element 13, concurrently radiate the pairs of parallel light beams to the adjacent light receiving sensor heads 30 on both sides in the time slots assigned thereto. Since the light radiating sensor heads/light receiving sensor heads 20/30 are arranged in such a manner that the light beams are not concurrently incident on both convex lenses 31L/31R of any one of the light receiving sensor heads 30, the eight light beams are guided to the eight optical fibers 3, and the light is propagated from the eight light receiving sensor heads 30 through the optical fibers 3, which form in combination one of the minor bundles FB(3), to the eight light input ports 17*a*. The incident light is converted to the photo current by means of the eight light detecting elements 19*a*. In the next time slot, the next light emitting element 13 is energized with the driving pulse signal, and other eight light radiating sensor heads 20 concurrently radiate the light beams to the adjacent light receiving sensor heads 30. Thus, the eight pairs of light beams are concurrently radiated from the eight light radiating sensor heads 20 in every time slots, and the eight light beams are guided to the optical fibers 3 of the associated one of the minor bundles FB(3). The ninety-six moving objects 1 are assigned to the ninety-six combinations between the twelve time slots and the eight light input ports 17*a*, and the data processing module can determine any one of the moving object 1 on the basis of the time slot and the light input port 17.

Figure 6A:
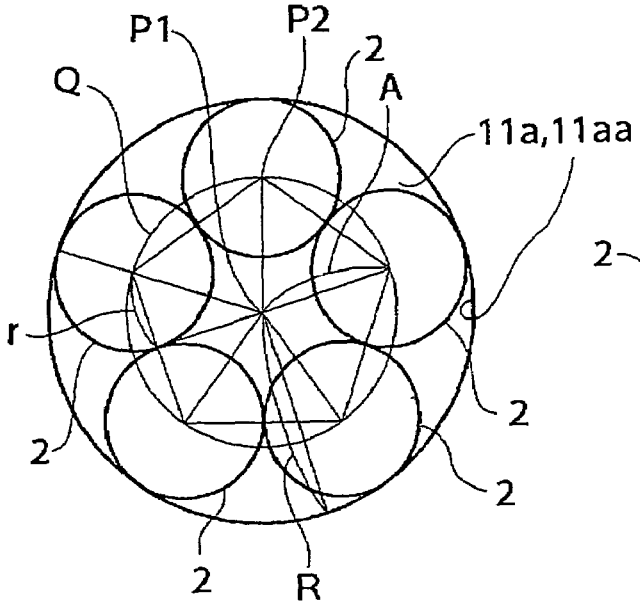
FIGS. 6A to 6D are schematic cross sectional views showing minor bundles of optical fibers inserted into the light emitting unit.
Figure 6B:
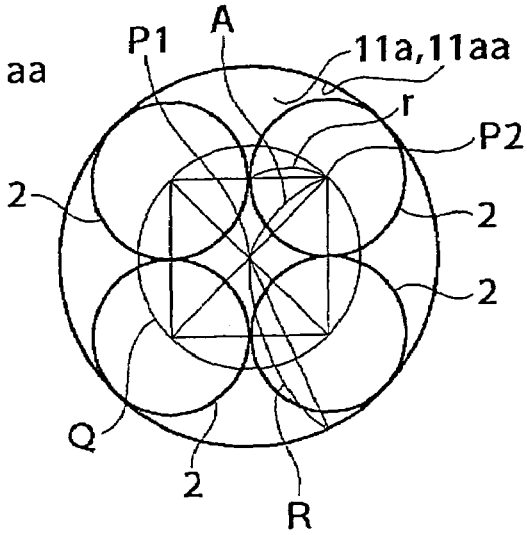
Figure 6C:
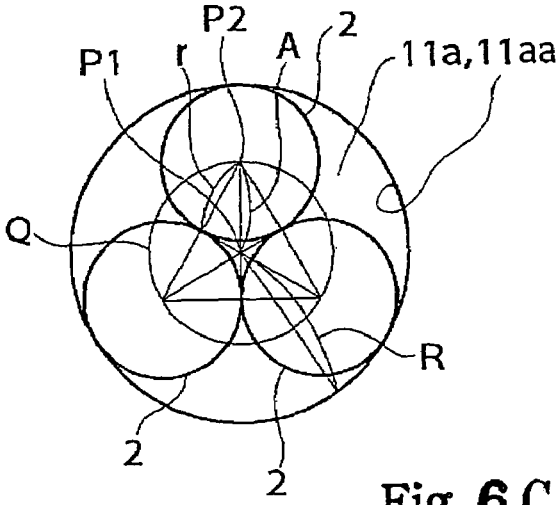
Figure 6D:
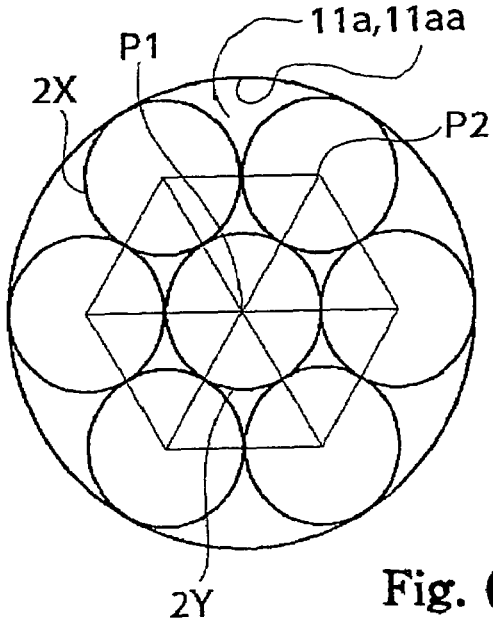

FIGS. 6A to 6C show several examples of the minor bundle FB(2). The light is distributed from each light emitting element 13 to the plural optical fibers 2, and the light is to be evenly incident on the end surfaces of the plural optical fibers 2. If seven optical fibers 2X and 2*y* are arranged in the cylindrical through-hole 11*a* as shown in FIG. 6D, the amount of light incident on the center optical fiber 2Y is maximum, and is larger than the amount of light incident on the other optical fibers 2X. A complex calibration is required for the light detecting unit 19. However, when the optical fibers 2 are arranged as shown in FIGS. 6A to 6C, the light is evenly incident on the plural optical fibers 2, and the complex calibration is avoidable.

In FIGS. 6A to 6C, reference sign P1 designates the center axis CL1 of the through-hole 11*a*, and reference sign P2 is indicative of the center axis of each optical fiber 2. The through-hole 11*a* has the radius of curvature "R", and the optical fibers 2 have the radius of curvature "r". "n" is the number of the optical fibers 2. The distance between the center axis P1 and each of the center axes P2 is represented by "A".

$$r=A\sin(\delta/n) \qquad \text{Equation 1}$$

Equation 1 is rewritten as $$A=r/\sin(\delta/n) \qquad \text{Equation 1'}$$

The radius of curvature R is expressed as $$R=A+r \qquad \text{Equation 2}$$

Substitute Equation 1' for A, then we obtain $$R=r+r/\sin(\delta/n) \qquad \text{Equation 3}$$

If the optical fibers 2 and the boundary of their bundle FB (2) satisfy equation 3, all of the optical fibers 2 are held in contact with the inner surface 11*aa* defining the through-hole 11*a*, each optical fiber 2 is further held in contact with the adjacent optical fibers 2, and the axes P2 of all the optical fibers 2 are on a virtual circle Q. The virtual circle Q has the center P1 coincident with the optical axis. Although the collimator lens 15*b* is provided between the light emitting diode 13 and the bundle FB(2) of optical fibers 2, the light intensity is reduced in a binomial distribution from the center axis P1. In other words, the light intensity is isotropically varied with respect to the optical axis coincident with the center axis P1. The optical axis CL5 is aligned with the center axis P1 so that the light intensity at the center axes P2 is equal to one another, because all the center axes P2 are on the virtual circle Q. The cross sections of optical fibers 2 overlapped with the virtual circle Q are equal in area to one another. For this reason, amount of light incident in each optical fiber 2 is approximately equal to the amount of light incident in the other optical fibers 2.

Even if the center axes P2 are slightly offset from the virtual circle Q, the fluctuation of the amount of incident light is negligible, because the center axes P2 are spaced from the center axis P1.

Since the optical fibers 2 are held in contact with the inner surface 11*aa* and the adjacent optical fibers 2, the friction therebetween is large, and, accordingly, the optical fibers 2 tend to stay in the cylindrical through-hole 11*a*. As described hereinbefore, the resilient force is exerted on the inner surface 11*aa* and adjacent optical fibers 2 so that the friction is large enough to keep the optical fibers 2 stable inside the cylindrical through-hole 11*a*. Thus, the optical fibers 2 are hardly drawn out from the optical fiber plug 11 during the solidification of the adhesive compound by virtue of the large friction.

It is preferable to select n from 3, 4 and 5, because the optical fibers 2 are automatically laid on the pattern shown in FIGS. 5A, 5B or 5C in the through-hole 11*a*. In other words, the assembling worker is expected to simply insert the three, four or five optical fibers 2 into each through-hole 11*a*. The space in the central zone is too narrow to accept an optical fiber 2. For this reason, the three, four or five optical fibers 2 occupy the peripheral zone of each through-hole 11*a* in such a manner as to satisfy Equation 3.

If n is 6, the six optical fibers 2X are held in contact with the inner surface defining the through-hole 11*a* and with one another, and, accordingly, satisfy Equation 3. However, there remains a space in the central zone as wide as an optical fiber. If any dummy fiber does not occupy the space, one of the six optical fibers 2X is fallen into the space, and the optical fibers 2X loose the pattern. In order to keep the six optical fibers 2X in the pattern, it is necessary to insert a dummy fiber 2Y into the space. If n is greater than 6, at least one dummy fiber 2Y is required for the optical fibers 2X. When the optical fibers 2X are inserted into the through-hole 11*a* together with the dummy fiber 2Y, the assembling worker is expected to keep the optical fibers 2X around the dummy fiber 2Y. If the dummy fiber 2Y is undesirably replaced with one of the optical fibers 2X, the optical transducer can not detect a present position of the moving object due to the dummy fiber 2Y. Thus, the assembling worker is expected to be more careful in the assembling work, and needs to slow down the work.

As will be understood from the foregoing description, the optical fibers 2/3 are warped along the unique route between the optical devices and the points at which they swerves, and exert the force on the surfaces of the optical devices during the work to fix the optical fibers 2/3 to the optical devices. The force gives rise to the large friction between the optical fibers and the surfaces, and keeps the optical fibers 2/3 immovable on the surfaces. As a result, the optical fibers 2/3 are securely fixed to the optical devices. In other words, the optical fibers do not fall out, and the optical transducer exactly converts the current position of the moving object to the electric signals. Even if an optical fiber 2/3 is not adhered to the optical device, the resilient force is still exerted on the surfaces so that the optical fibers 2/3 are continuously pressed thereto. The friction keeps the optical fiber 2/3 inside the optical device so that the optical fibers 2/3 do not fall out.

The major bundle AFB is desirable from the viewpoint that the worker easily clips the optical fibers 2/3 onto the predetermined route. Another advantage of the major bundle AFB is the uniformity in the light propagation loss along the optical fibers 2/3, because the optical fibers 2/3 in the warped portion AFBa have values of the radius of curvature approximately equal to one another.

The arrangement of the light radiating sensor heads/light receiving sensor heads 20/30 is desirable from the viewpoint of the reduction in the light propagation loss. In detail, if the light radiating sensor heads/light receiving sensor heads 20/30 are directed oppositely to those shown in FIG. 1, the major bundle AFB is to be sharply bent on the right end portions of the front/rear sections 42/43. On the contrary, the head portions 20*a*/30*a* are directed to the light emitting unit/light detecting unit 10/19 so that the route for the major bundle AFB has a large radius of curvature. This results in the relatively gentle curve, and the light propagation loss is reduced.

In the embodiment described hereinbefore, the center axis of the major bundle AFB on the rear section 43 is spaced from the center axis of the major bundle AFB in the vicinity of the light detecting unit 19 on the front section 42 by 7 centimeters, and the warped portion AFBa has the radius of curvature of the order of 3.5 centimeters. In the prior art, the corresponding distance is 4.5–5.0 centimeters, and the radius of curvature ranges from 2.25 centimeters to 2.50 centimeters. Since the major bundle is about 1 centimeter in diameter, the bundle is sharply curved in the prior art. On the other hand, the major bundle AFB is gently curved on both sides of the connecting plate 40*b* so that the worker easily handles the major bundle AFB in the assembling work. Thus, the connecting plate 40*b* is advantageous over the prior art base frame.

Musical Instrument

Automatic Player Piano

Figure 7:
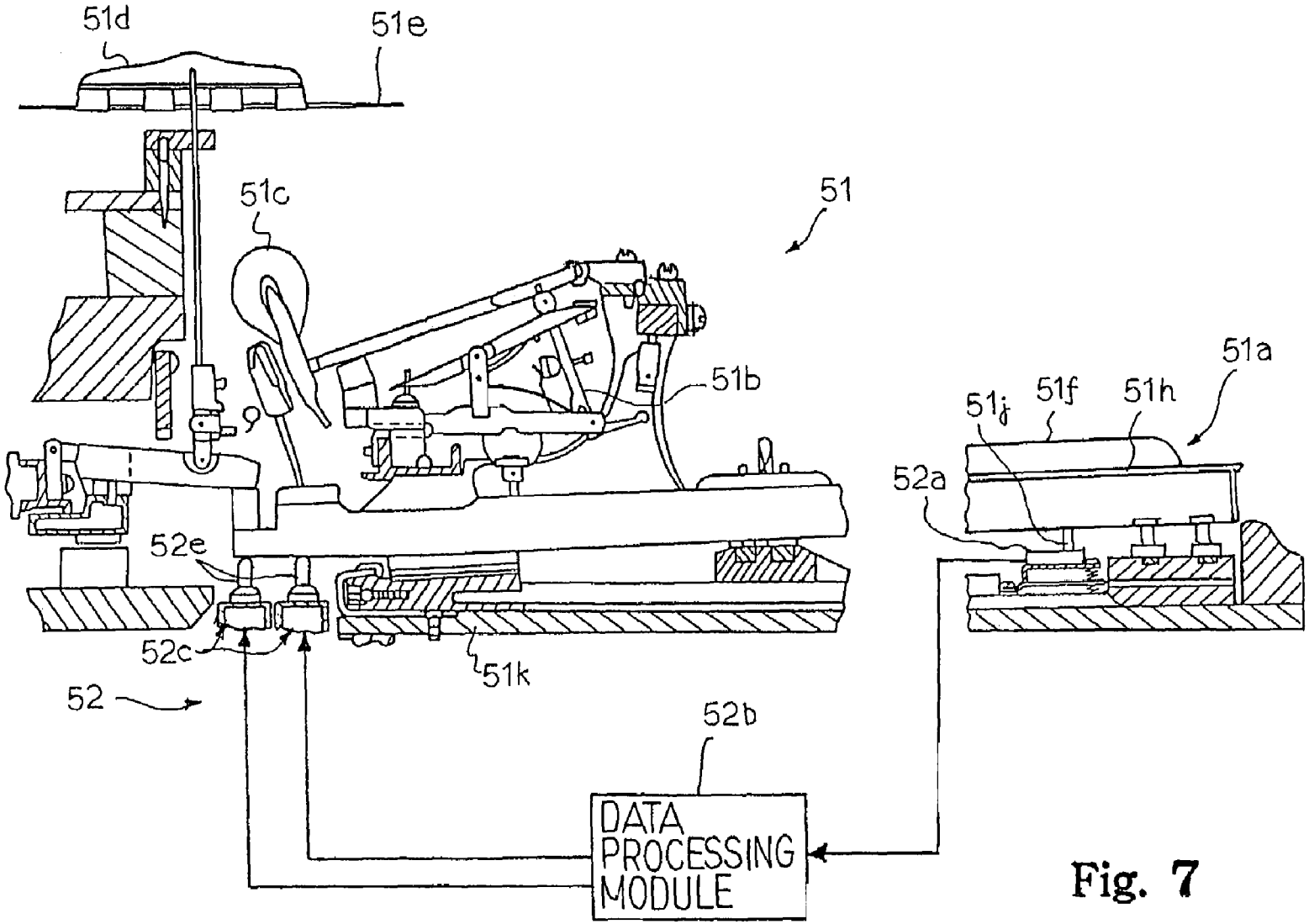
FIG. 7 is a side view showing the structure of an automatic player piano according to the present invention.

The optical transducer according to the present invention is available for musical instruments. FIG. 7 shows an automatic player piano embodying the present invention. The automatic player piano largely comprises a grand piano 51 and an automatic playing system 52. The automatic playing system 52 is installed in the grand piano 51, and plays pieces of music on the grand piano 51 without any fingering. In this instance, the automatic playing system is operative to not only reproduce a performance on the grand piano 51 but also records a performance in an information storage medium.

The grand piano 51 includes a keyboard 51*a*, action units 51*b*, hammers 51*c*, dampers 51*d* and strings 51*e*. The keyboard 51*a* has black keys 51*f* and white keys 51*h*, which are laid on the well-known pattern, and are independently moved between the rest positions and the end positions. The black/white keys 51*f*/51*h* are linked at the capstan screws with the action units 51*b* and at the rearmost portions to the dampers 51*d*, and the hammers 51*c* are connected to the action units 51*b* below the strings 51*e*.

When a black/white key 51*f*/51*h* is depressed, the depressed key 51*f*/51*h* pushes up the damper 51*d*, and actuates the action unit 51*b*. Then, the damper 51*d* is spaced from the string 51*e* so that the string 51*e* gets ready to vibrate. On the other hand, the action unit 51*b* escapes from the hammer 51*c*. Then, the hammer 51*c* starts free rotation toward the string 51*e*. The hammer 51*c* rebounds on the string 51*e* so as to give rise to the vibrations of the string 51*e*, and the action unit 51*b* receives the hammer 51*c*. When the depressed key 51*f*/51*h* is released, the action unit 51*b* and hammer 51*c* return to the respective rest positions, and the damper 51*d* is brought into contact with the string 51*e*, again. Thus, the grand piano 51 behaves as similar to standard grand pianos.

The automatic playing system 52 includes an optical transducer 52*a*, a data processing module 52*b* and solenoid-operated key actuators 52*c*. The optical transducer 52*a* is provided under the black/white keys 51*f*/51*h*, and monitor shutter plates 51*j*, which project from the lower surfaces of the black/white keys 51*f*/51*h*. The optical transducer 52*a* is similar to the optical transducer shown in FIGS. 1 to 5, and no further description is hereinafter incorporated for avoiding undesirable repetition. The shutter plates 51*j* are corresponding to the moving objects 1, and gradually interrupt the parallel light beams in the downward motion of the associated black/white keys 51*f*/51*h*. The optical transducer 52*a* converts the amount of incident light to electric signals representative of the current key positions of the associated black/white keys 51*f*/51*h*. The electric signals are supplied from the optical transducer 52*a* to the data processing module 52*b*.

The solenoid-operated key actuators 52*c* are partially embedded in the key bed 51*k*, and selectively energized with a driving pulse signal. While the data processing module 52*b* is energizing a solenoid-operated key actuator 52*c*, the plunger 52*e* projects from the solenoid (not shown), and pushes the rear portion of the associated black/white key 51*f*/51*h*, upwardly. On the way toward the end position, the damper 51*d* is spaced from the string 51*e*, and the action unit 51*b* escapes from the hammer 51*c*. Thus, the black/white keys 51*f*/51*h* are sequentially driven to actuate the other component parts without the fingering of a human player, and the performance is replayed by means of the automatic playing system.

The data processing module 52*b* has a playback mode and a recording mode. When the data processing module 52*b* enters the playback mode, the data processing module 52*b* sequentially fetches music data codes representative of the performance, and analyzes the fetched data codes to see what key or keys 51*f*/51*h* are to be moved. The data processing module 52*b* is further determined a time at which the key or keys are to be moved. When the time comes, the data processing module 52*b* supplies the driving pulse signal to the solenoid-operated key actuator 52*c*, and causes the plunger 52*e* to push the rear portion of the key 51*f*/51*h* upwardly as described hereinbefore.

On the other hand, when the automatic player piano is established in the recording mode, the data processing module 52*b* periodically checks the electric signals to see whether or not any one of the black/white keys 51*f*/51*h* is depressed or released by the human player. The human player is assumed to depress a black key 51*f*. The data processing module 52*b* specifies the depressed key 51*f*, and calculates the key velocity. The data processing module 52*b* produces music data codes representative of the depressed key 51*f*, key velocity and the lapse of time from the initiation of the performance to the key-on event. Similarly, when the human player releases the depressed key 51*f*, the data processing module 52*b* produces music data codes representative of the released key and the lapse of time to the key-off event. The data processing module 52*b* repeats the above-described jobs for the depressed keys and released keys until the end of the performance. As will be understood, the optical transducer 52*a* is an integral system component of the automatic playing system 52.

The optical transducer 52*a* is expected exactly to report the key motion to the data processing module 52*b*. Eighty-eight black/white keys 51*f*/51*h* are usually incorporated in the keyboard 51*a*, and, accordingly, the eight-eight shutter plates 51*j* are monitored through the optical transducer. If any one of the optical fibers 2/3 falls out from the optical device 10/19/20/30, the corresponding electronic tone is missing from the playback. However, the optical transducer 52*a* according to the present invention keeps the optical fibers 2/3 securely fixed to the optical devices 10/19/20/30. For this reason, the automatic player piano according to the present invention is highly reliable.

Mute Piano

Figure 8:
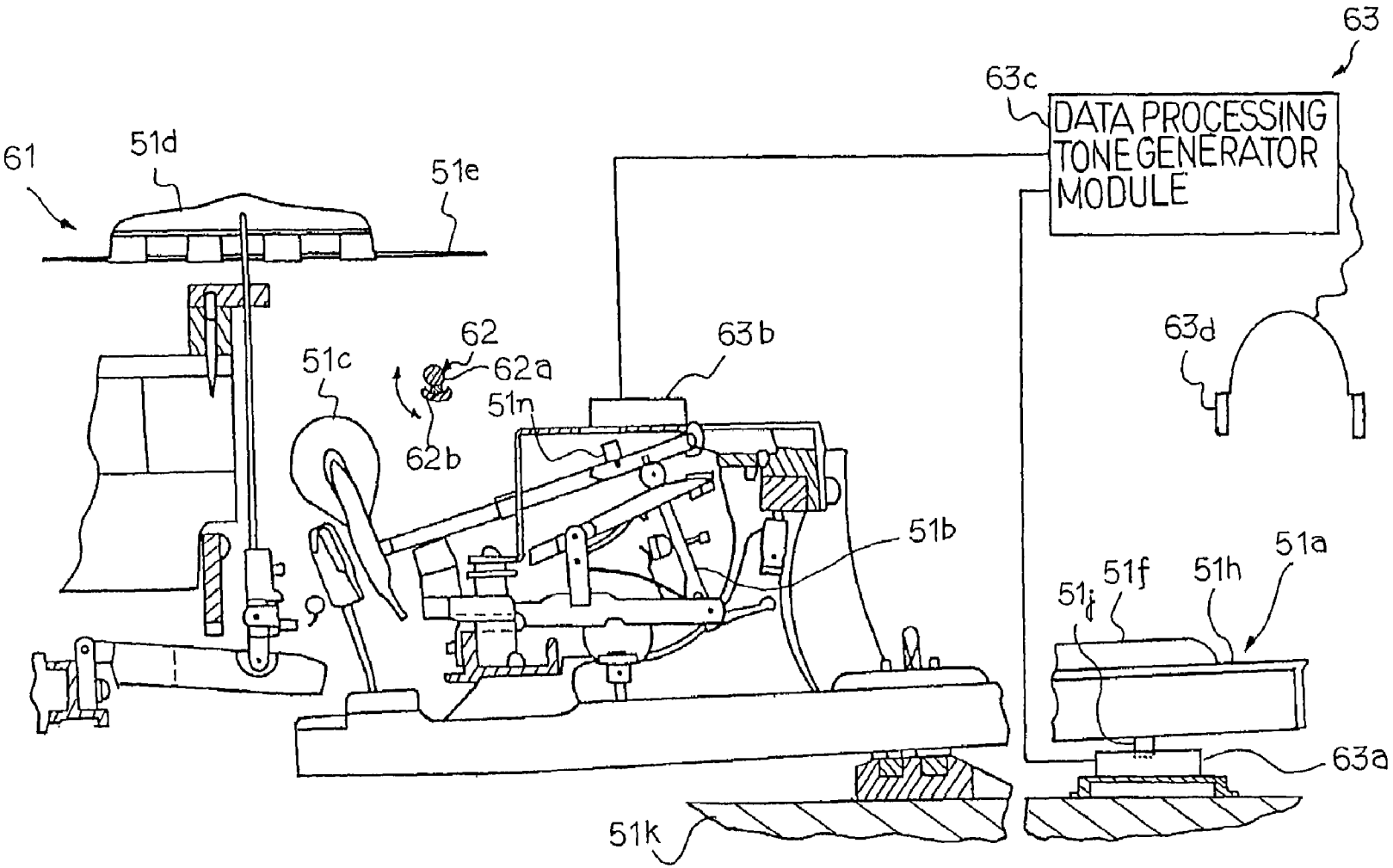
FIG. 8 is a side view showing the structure of a mute piano according to the present invention.

Turning to FIG. 8 of the drawings, a mute piano largely comprises a grand piano 61, a hammer stopper 62 and an electronic tone generating system 63. The grand piano 61 is similar in structure to the grand piano 51. Component parts of the grand piano 61 are labeled with the references designating the corresponding component parts of the grand piano 51 without detailed description for the sake of simplicity.

The hammer stopper 62 laterally extends over the hammers 51*c*, and is turnable about the center axis of a rod 62*a*. A shock absorber 62*b* projects from the rod 62, and is moved into and out of the trajectories of the hammers 51*c*. While the hammer stopper 62 is keeping the shock absorber 62*b* outside of the trajectories, the strings 51*e* are struck with the hammers 51*c* as similar to the standard grand pianos for producing the tones. When the pianist turns the rod 62*a*, the shock absorber 62*b* is moved into the trajectories of the hammers 51*c*. While the pianist is fingering on the keyboard 51*a*, the depressed keys 51*f*/51*h* cause the associated action units 51*b* to escape from the hammers 51*c*, and give rise to the free rotation. However, the hammers 51*c* rebound on the shock absorber 62*b* before reaching the strings 51*e*. As a result, any acoustic piano tone is not generated from the strings 51*e*. Instead, the electronic tone generating system 63 produces electronic tones at the pitches of the acoustic piano tones as follows.

The electronic tone generating system 63 includes an array of key sensors 63*a*, an array of hammer sensors 63*b*, a data processing/tone generator module 63*c* and a headphone 63*d*. The optical transducer shown in FIGS. 1 to 5 is employed as the array of key sensors 63*a* and array of hammer sensors 63*b*. The shutter plates 51*j* serve as the moving objects to be monitored with the array of key sensors 63*a*. Other shutter plates 51*n* are respectively attached to the hammer shanks of the hammers 51*c*, and serve as the other moving objects 1 to be monitored with the array of hammer sensors 63*b*.

The pianist is assumed to move the shock absorber 62*b* into the trajectories of the hammers 51*c*. While the pianist is fingering a piece of music on the keyboard 51*a*, he or she depresses the black key 51*f*, and, thereafter, releases the depressed black key 51*f*. The key motion is reported from the array of key sensors 63*a* through a key position signal to the data processing/tone generator module 63*c*. Then, the data processing/tone generator module 63*c* specifies the depressed black key 51*f*, and calculates the key velocity. The depressed black key 51*f* causes the action unit 51*b* to escape from the hammer 51*c* so that the hammer 51*c* starts the free rotation. The hammer sensor 63*b* detects the shutter plate 51*n* immediately before the rebound on the shock absorber 62*b*, and reports the arrival to the data processing tone generator module 63*c*. Then, the data processing unit supplies the music data codes representative of the note-on, key code and key velocity to the tone generator, and the tone generator produces an audio signal from pieces of waveform data stored therein. The audio signal is supplied to the headphone 63*d*, and is converted to the electronic tone.

Thus, the array of key sensors 63*a* and array of hammer sensors 63*b* are integral component parts of the electronic tone generating system 63, and are expected exactly to report the key motion and hammer motion to the data.

processing/tone generator module 63*c*. Eighty-eight black/white keys 51*f*/51*h* are usually incorporated in the keyboard 51*a*, and, accordingly, the eight-eight shutter plates 51*j* are monitored through the array of key sensors 63*a*. Similarly, the eighty-eight hammers 51*c* are incorporated in the grand piano 61, and the eighty-eight shutter plates 51*n* are monitored through the array of hammer sensors 63*b*. If any one of the optical fibers 2/3 falls out from the optical device 10/19/20/30, the corresponding electronic tone is missing from the performance. However, the optical transducer according to the present invention keeps the optical fibers 2/3 securely fixed to the optical devices 10/19/20/30. For this reason, the mute piano according to the present invention is highly reliable.

Although particular embodiments of the present invention have been shown and described, it will be apparent to those skilled in the art that various changes and modifications may be made without departing from the spirit and scope of the present invention.

Figure 9:
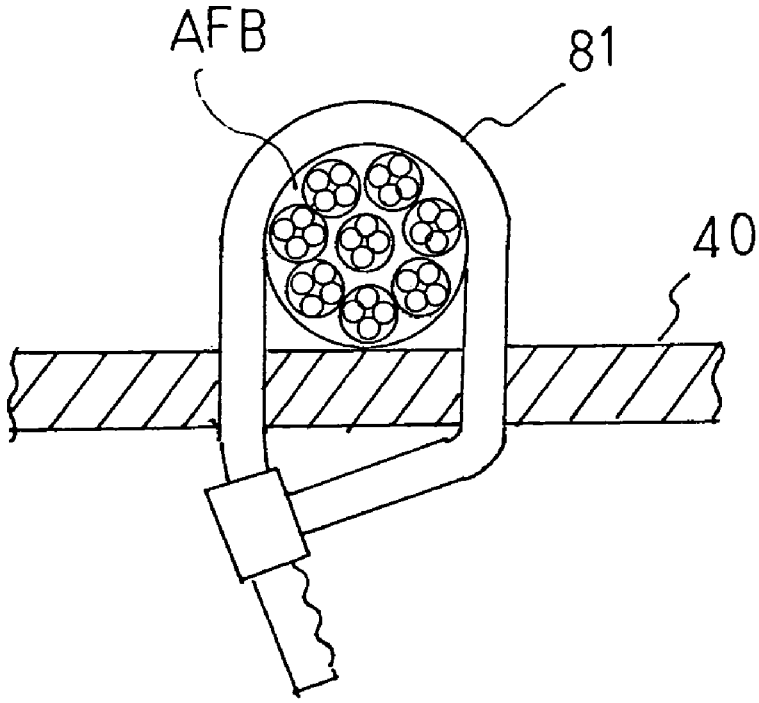
FIG. 9 is a cross sectional view showing a minor bundle connected to a base frame by means of a pull strap.
Figure 10:
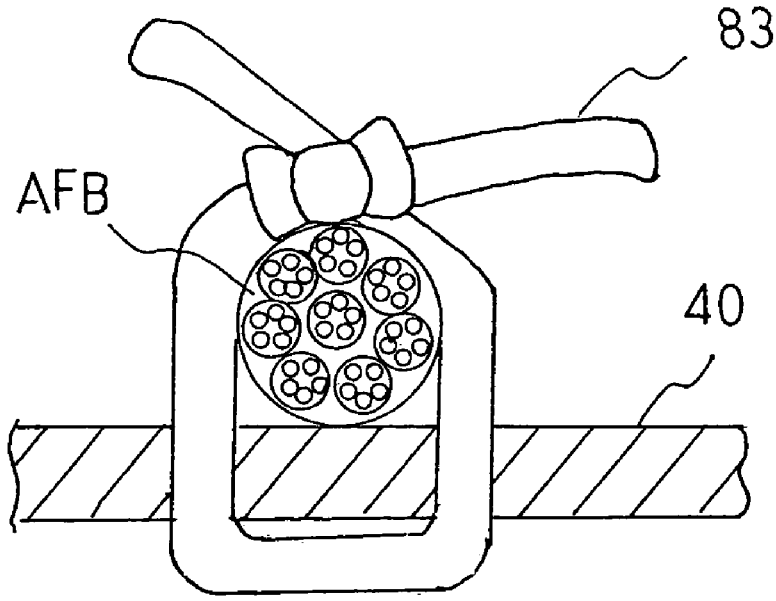
FIG. 10 is a cross sectional view showing a major bundle connected to a base frame by means of a piece of impregnated paper.
Figure 11:
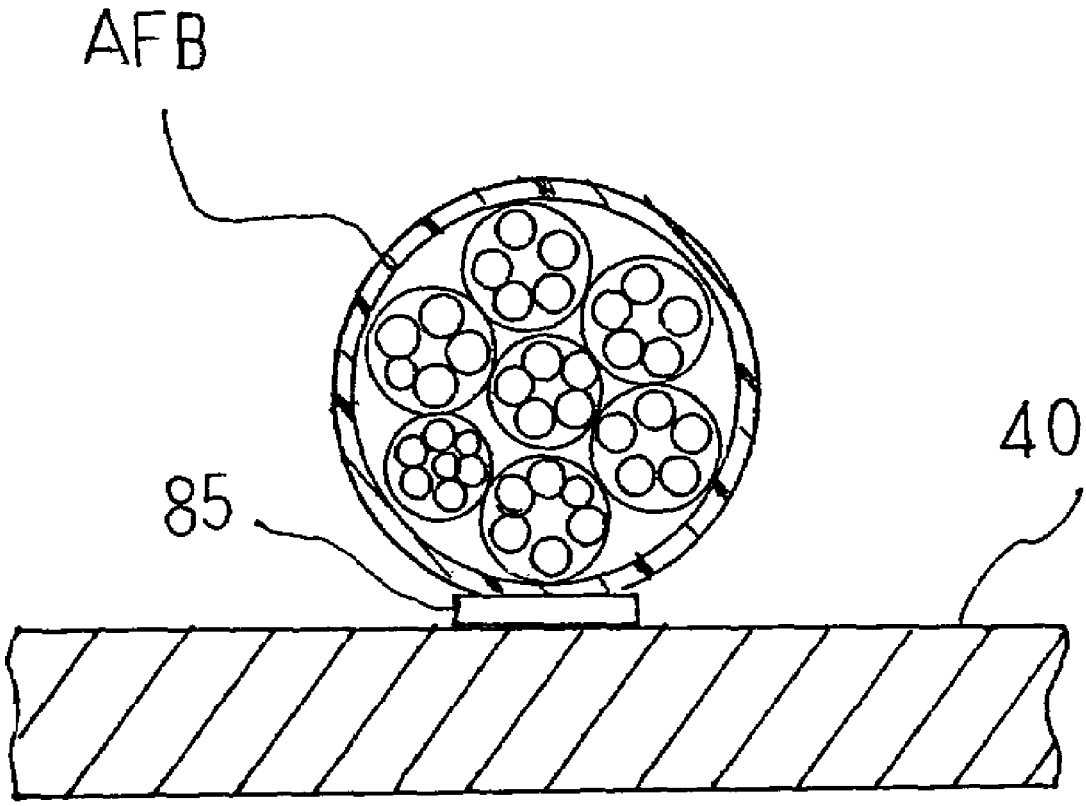
FIG. 11 is a cross sectional view showing a major bundle connected to a base frame by means of a piece of adhesive double coated tape.

The synthetic resin strip 41*a* does not set any limit to the technical scope of the present invention. The major bundle AFB may be secured to the base frame 40 by means of a pull strap 81 as shown in FIG. 9. The pull strap 81 is manufactured as "Insulok" (trademark) by Hellermann Tyton Corporation. A piece of impregnated paper 83 (see FIG. 10) is available for the optical transducer. A piece of paper is impregnated with synthetic resin, and the major bundle AFB is tied to the base frame 40 with the piece of impregnated paper 83. Otherwise, the major bundle AFB is secured to the base frame by means of a sheet of adhesive double coated paper 85 as shown in FIG. 11.

The twelve light output ports A to L and eight light input ports 17*a* do not set any limit to the technical scope of the present invention. The number of the light output ports and the number of light input ports are depending upon the number of moving objects and the number of time slots definable in each time frame. If the moving objects are more than 96, either of or both of the light input ports/light output ports are increased. On the other hand, if the moving objects are less than 88, eleven the light detecting unit 19 with the eight light input ports 17*a* may be used together with a light emitting unit with eleven light output ports.

The light receiving sensor heads and light receiving sensor heads may be replaced with the light emitting blocks, light detecting blocks disclosed in U.S. Pat. No. 5,909,028. A single light beam may be radiated from another sort of light radiating sensor head to an adjacent light receiving sensor head. These sorts of sensor heads are available for the optical transducer according to the present invention.

Figure 3:
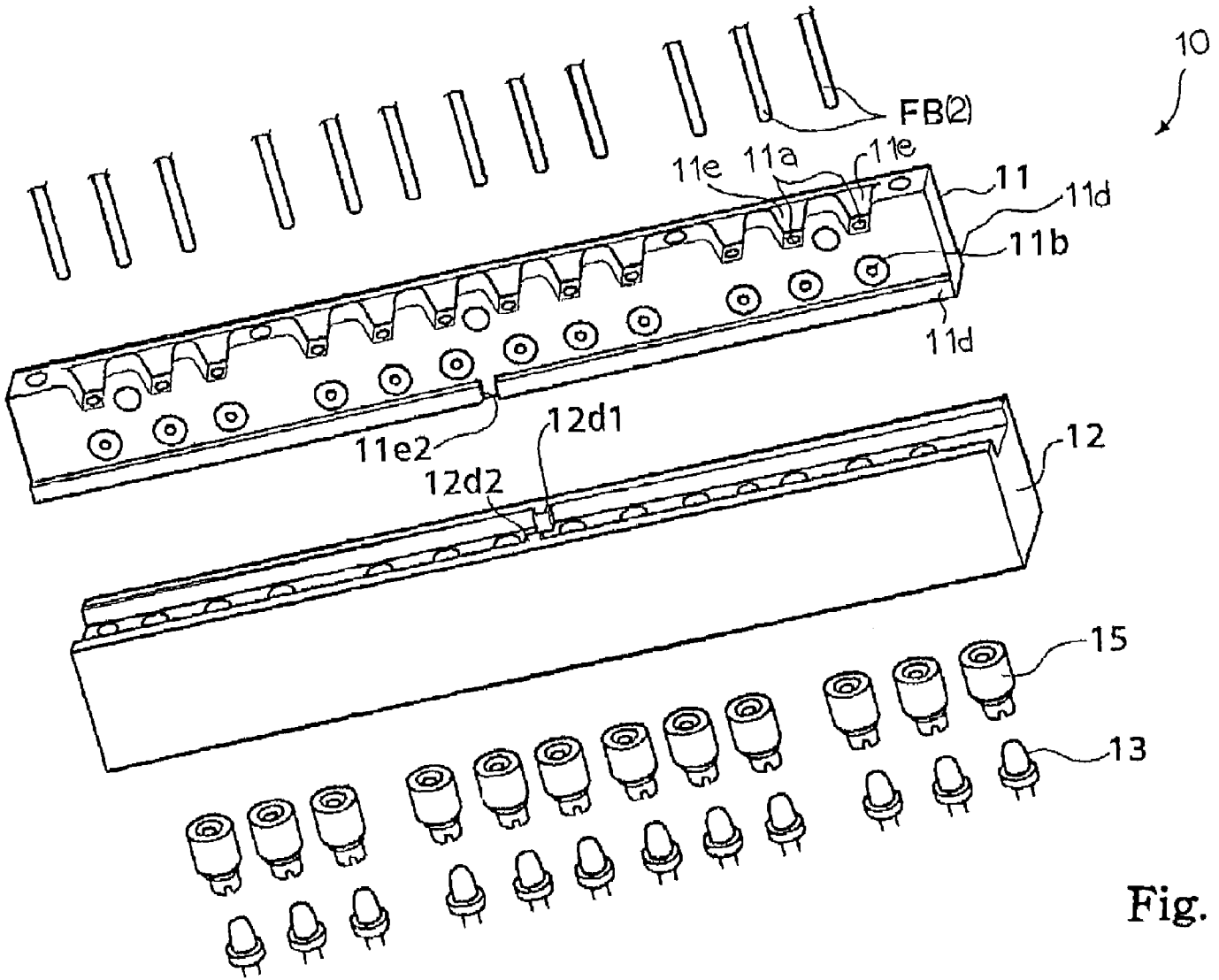
FIG. 3 is a perspective view showing component parts of a light emitting unit, which also forms a part of the optical transducer.
Figure 4:
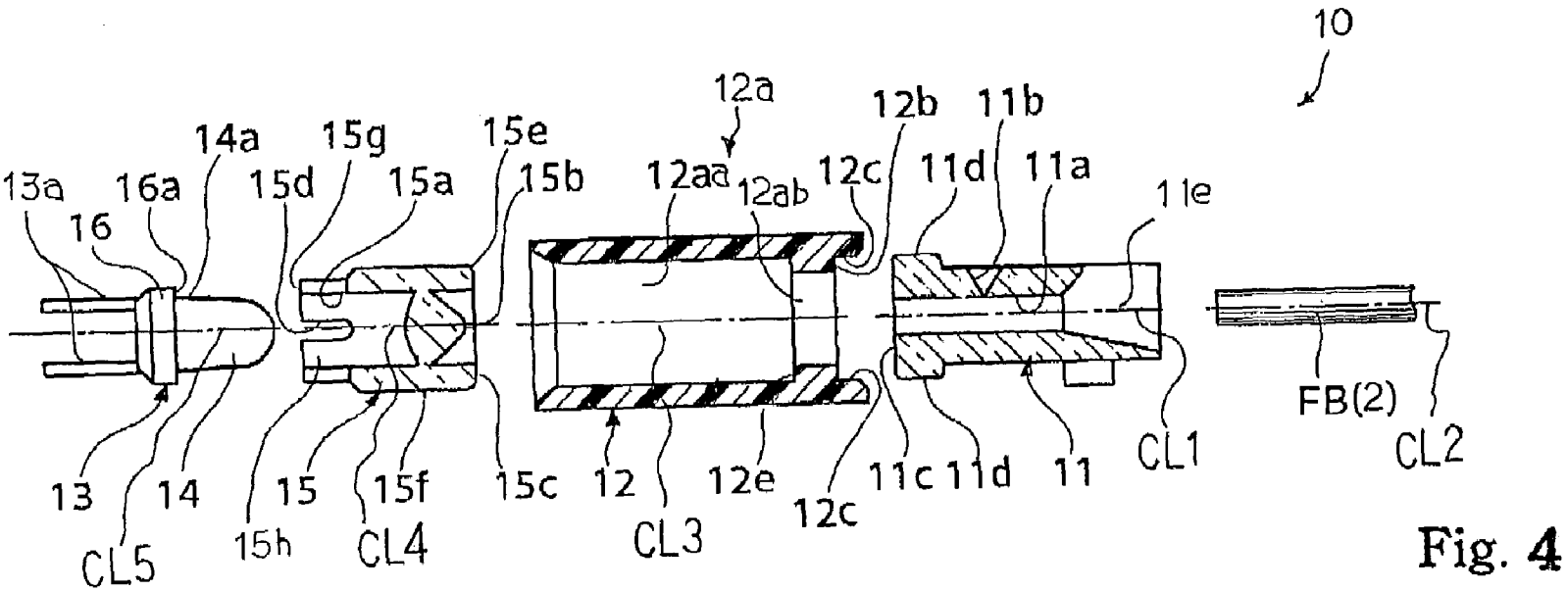
FIG. 4 is a cross sectional view showing the component parts of the light emitting unit.
Figure 5:
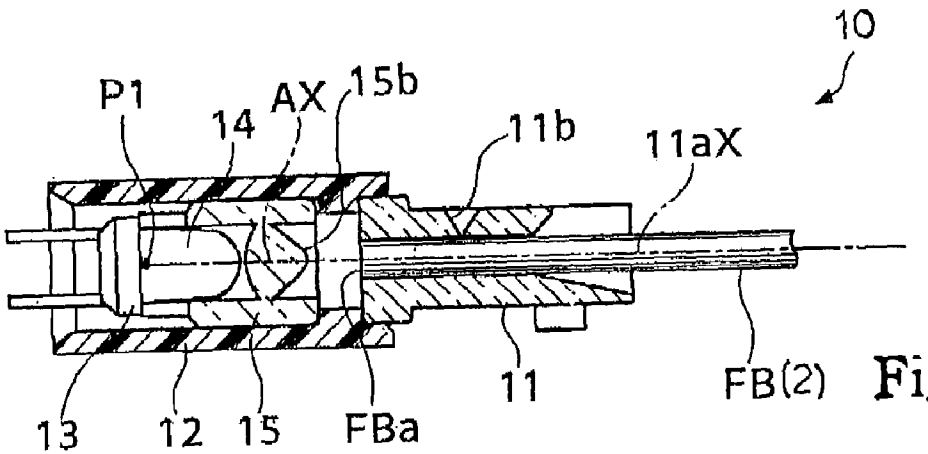
FIG. 5 is a cross sectional view showing the structure of the light emitting unit.

The structure shown in FIGS. 3 to 5 is an example of the light emitting unit available of the optical transducer according to the present invention. The optical fiber plug 11 and light emitting diode socket may be replaced with a monolithic casing.

The arrangement of the component parts shown in FIG. 1 does not set any limit to the technical scope of the present invention. If the moving objects 1 are located differently from the those shown in FIGS. 1 and 2, the light radiating sensor heads/light receiving sensor heads 20/30 are to be moved to other areas adjacent to the moving objects 1. Moreover, the light emitting unit 10 may be widely spaced and offset from the light detecting unit 19. Moreover, the light receiving sensor heads 30 may be located on the same side as the light radiating sensor heads 20 for receiving the reflection on the moving objects 1.

The base frame 40 does not set any limit to the technical scope of the present invention. The front section 42, rear section 43 and connecting plate 40*b* may be separated from one another in so far as they do not change the relative position.

The optical fibers 2/3 may be bundled into more than one major bundle. As described hereinbefore, the reason why the optical fibers 2/3 are bundled into the major bundle AFB is that the major bundle AFB is easily clipped on the predetermined route. If more than one major bundle makes the working efficiency enhanced rather than the single major bundle AFB, the minor bundles FB(2)/FB(3) are bundled into more than one major bundles. In case where the light emitting unit 10 and light detecting unit 19 are located in areas spaced from each other, the minor bundles FB(2) and minor bundles FB(3) may be bundled into different major bundles so as to be clipped on different routes.

The minor bundles FB(2)/FB(3) may be bundled into the major bundle AFB without the shield 41*c*. In this instance, the rings 41*b* may be required for the major bundle AFB at short intervals.

The acrylic resin, acrylonitril-butadiene-styrene and polycarbonate do not set any limit to the technical scope of the present invention. The optical fibers 2/3 may be made of another sort of transparent material in so far as the material exhibits the resiliency. The optical fiber plug 11 light emitting diode socket 12 may be made of another sort of transparent material and yet another sort of synthetic resin.

The light cured adhesive compound does not set any limit to the technical scope of the present invention. Any sort of adhesive compound is available for the assemblage. Moreover, the minor bundles FB(2)/FB(3) and optical fibers 2/3 may be connected to the plugs 11/17 and the sensor heads 20/30 by means of a mechanical coupling.

The synthetic resin strips 41*a* may be replaced with strings, clips or holders adhered to the reverse surface.

The automatic player piano and mute piano do not restrict the musical instrument to which the present invention appertains. The optical transducer according to the present invention is applicable to any sort of electronic musical instrument such as, for example, electronic stringed instruments, electronic percussion instruments and electronic wind instruments.

Claims languages are correlated with the component parts of the embodiment as follows. The current positions of the moving objects 1 are corresponding to "status" of "objects". The light radiating sensor heads 20 and light receiving sensor heads as a whole constitute "plural optical sensor heads". The front section 42, rear section 43 and connecting plate 40*b* form in combination "frame". The rings 41*a* are corresponding to "plural couplers".

The black/white keys 51*f*/51*h* serve as "manipulators", and the data processing/tone generating module 63*c* serves as "tone generating system". In case where the data processing module 52*b* supplies the music data codes to the solenoid-operated key actuators 52*c* of another keyboard musical instrument remote from the automatic player piano in a real time fashion, the solenoid-operated key actuators 52*c*, keyboard 51*a*, action units 51*b*, hammers 51*c*, dampers 51*d* and strings 51*e* of another keyboard musical instrument and the data processing module 52*b* as a whole constitute "tone generating system". The pitches are an "attribute" of tones. The action unit 51*b*, hammer 51*c* and string 51*e* form in combination each "mechanical tone generating unit".

What is claimed is:

1. An optical transducer for converting status of objects to electric signals, comprising:

a light emitting unit for emitting light;

a light detecting unit for converting incident light to said electric signals;

plural optical sensor heads selectively coupled to said light emitting unit and said light detecting unit, and bridging gaps respectively assigned to said objects with said light so as to supply said incident light representative of said status of said objects to said light detecting unit;

a frame having a route immovable with respect to said light emitting unit, said light detecting unit and said plural optical sensor heads;

plural optical fibers connected between said light emitting unit, said light detecting unit and said plural optical sensor heads, and having respective warped-end portions connected to at least either said light emitting unit and light detecting unit or said plural optical sensor heads so as to be resiliently held in contact with said at least either said light emitting unit and light detecting unit or said plural optical sensor heads; and a fastener keeping said plural optical fibers stable on said route.

2. The optical transducer as set forth in claim 1, in which said plural optical fibers are bundled into at least one major bundle.

3. The optical transducer as set forth in claim 2, in which said at least one major bundle is wrapped in a shield.

4. The optical transducer as set forth in claim 3, in which said plural optical fibers are locked in said shield with plural couplers.

5. The optical transducer as set forth in claim 1, in which said light emitting unit, said light detecting unit and said plural optical sensor heads are mounted on said frame.

6. The optical transducer as set forth in claim 5, in which said light emitting unit and said light detecting unit are assigned to an area on a surface of said frame, and said plural optical sensor heads are assigned to another area on said surf ace spaced from said area in a certain direction.

7. The optical transducer as set forth in claim 6, in which said plural optical fibers are inserted into holes of said plural optical sensor heads open to the outside thereof on the opposite side to said light emitting unit and light detecting unit so that said route is gently curved on said surface.

8. The optical transducer as set forth in claim 1, in which said light emitting unit and said light detecting unit are respectively formed with plural light output ports and plural light input ports, and said plural optical fibers are grouped into plural minor bundles having said warped end portions selectively inserted into said plural light output ports and said plural light input ports.

9. The optical transducer as set forth in claim 8, in which said minor bundles are adhered to inner surfaces defining said plural light output ports and said plural light input ports, and the optical fibers of each minor bundle are further adhered to one another.

10. The optical transducer as set forth in claim 8, in which said minor bundles are gathered into at least one major bundle, and said optical fibers are swerve from said at least one major bundle at intervals so as to be have other warped end portions inserted into holes respectively formed in said plural optical sensor heads, respectively.

11. The optical transducer as set forth in claim 10, in which said at least one major bundle is locked in a shield with plural couplers.

12. The optical transducer as set forth in claim 10, in which said plural optical sensor heads are arranged in an area of said frame at intervals in a certain direction, and said light output ports and said light input ports are arranged in another area of said frame at intervals in a direction parallel to said certain direction so that said at least one major bundle has an end portion extending along said light output ports and said light input ports, another end portion extending along said plural optical sensor heads and a warped portion curved between said area and said another area.

13. The optical transducer as set forth in claim 12, in which said holes of said plural optical sensor heads are open to the outside on the opposite side to said light emitting unit and said light detecting unit so that said warped portion is gently curved.

14. The optical transducer as set forth in claim 10, in which said at least one major bundle is fixed to said frame at intervals by means of said fastener.

15. A musical instrument for producing tones, comprising:

plural manipulators independently moved for specifying an attribute of tones;

an optical transducer monitoring said plural manipulators to see whether or not said manipulators change status so as to produce pieces of Status data representative of said status, and including a light emitting unit for emitting light, a light detecting unit determining said status on the basis of incident light, plural optical sensor heads selectively coupled to said light emitting unit and said light detecting unit, and bridging gaps respectively assigned to said manipulators with said light for supplying said incident light to said light detecting unit, a frame having a route immovable with respect to said light emitting unit, said light detecting unit and said plural optical sensor heads, plural optical fibers connected between said light emitting unit, said light detecting unit and said plural optical sensor heads, and having respective warped end portions connected to at least either said light emitting unit and light detecting unit or said plural optical sensor heads so as to be resiliently held in contact with said at least either said light emitting unit and light detecting unit or said plural optical sensor heads and a fastener keeping said plural optical fibers stable on said route; and a tone generating system connected to said optical transducer, and producing said tones on the basis of said pieces of status data.

16. The musical instrument as set forth in claim 15, in which said tone generating system further includes plural actuators selectively energized for moving said plural manipulators.

17. The musical instrument as set forth in claim 15, further comprising plural mechanical tone generating units respectively linked with said plural manipulators and selectively actuated so as to give rise to vibrations of strings for acoustic tones, and a stopper moved into and out of said plural mechanical tone generating units, and prohibiting said strings from said vibrations when said stopper is moved into said plural mechanical tone generating units.

18. The musical instrument as set forth in claim 15, in which said plural optical fibers are gathered into at least one major bundle fixed to said frame by means of said fastener.

19. The musical instrument as set forth in claim 15, in which said plural optical fibers further have other warped end portions, and said warped end portions and said other warped end portions are connected to said light emitting unit and light detecting unit and said plural optical sensor heads, respectively.

20. The musical instrument as set forth in claim 19, in which resiliency of said plural optical fibers urge said warped end portions and said other warped end portions to surfaces of said light emitting unit, said light detecting unit and said plural optical sensor heads so as to prohibit said warped end portions and said other warped end portions from separating from said surfaces.

* * * * *